US006463614B1

(12) United States Patent
Supra

(10) Patent No.: US 6,463,614 B1
(45) Date of Patent: Oct. 15, 2002

(54) POOL CLEANER

(75) Inventor: Carl Frederick Wilhelm Supra, Krugersdorp (ZA)

(73) Assignee: Mocani (Pty) LTD, Rispark (ZA)

( * ) Notice: Subject to any disclaimer, the term of this patent is extended or adjusted under 35 U.S.C. 154(b) by 0 days.

(21) Appl. No.: 09/555,261

(22) PCT Filed: Nov. 26, 1998

(86) PCT No.: PCT/AU98/00976

§ 371 (c)(1),
(2), (4) Date: May 26, 2000

(87) PCT Pub. No.: WO99/28577

PCT Pub. Date: Jun. 10, 1999

(30) Foreign Application Priority Data

Nov. 26, 1997 (ZA) ..... 97/10627

(51) Int. Cl.[7] ..... E04H 4/16
(52) U.S. Cl. ..... 15/1.7; 15/246
(58) Field of Search ..... 15/1.7, 246

(56) References Cited

U.S. PATENT DOCUMENTS 4,152,802 A * 5/1979 Chauvier
4,807,318 A * 2/1989 Kallenbach
5,014,382 A * 5/1991 Kallenbach
5,418,995 A * 5/1995 Rice
5,421,054 A * 6/1995 Dawson
5,433,985 A * 7/1995 Atkins
5,617,606 A * 4/1997 Scott, II
6,311,353 B1 * 11/2001 Phillipson

FOREIGN PATENT DOCUMENTS

EP 0556029 * 8/1993
WO 95/12732 * 5/1995

* cited by examiner

*Primary Examiner*—Randall E. Chin
(74) *Attorney, Agent, or Firm*—Young & Thompson

(57) ABSTRACT

The pool cleaner includes a body and at least one member secured to the body and which, in use, engages a submerged surface to be cleaned, thereby preventing the body from directly contacting the submerged surface. The member and at least part of the body are rotatable relative to each other. A skirt may be attached to the member, or the member may take the form of a skirt.

18 Claims, 2 Drawing Sheets

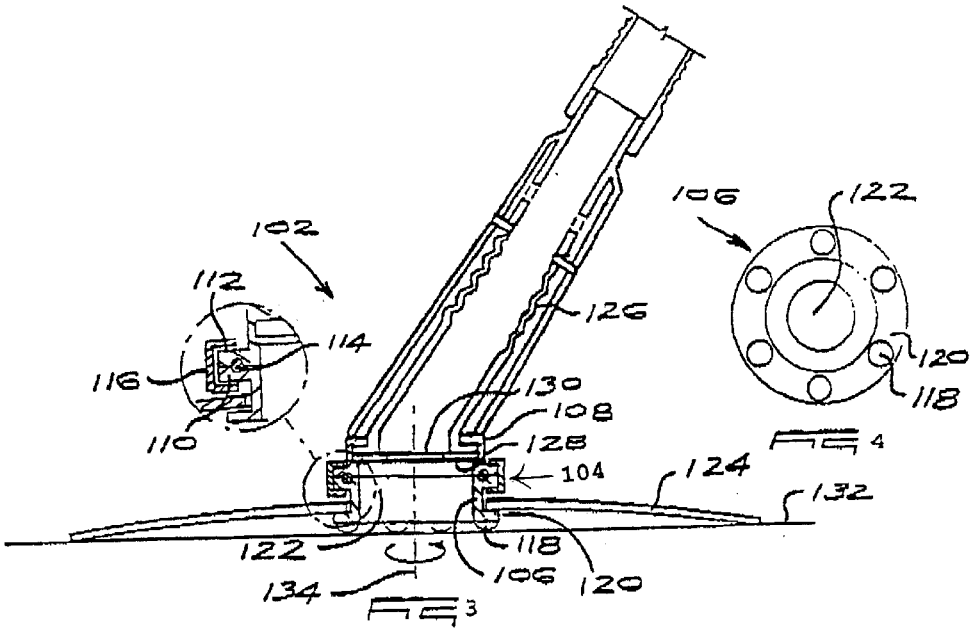
FIG 3
FIG 4
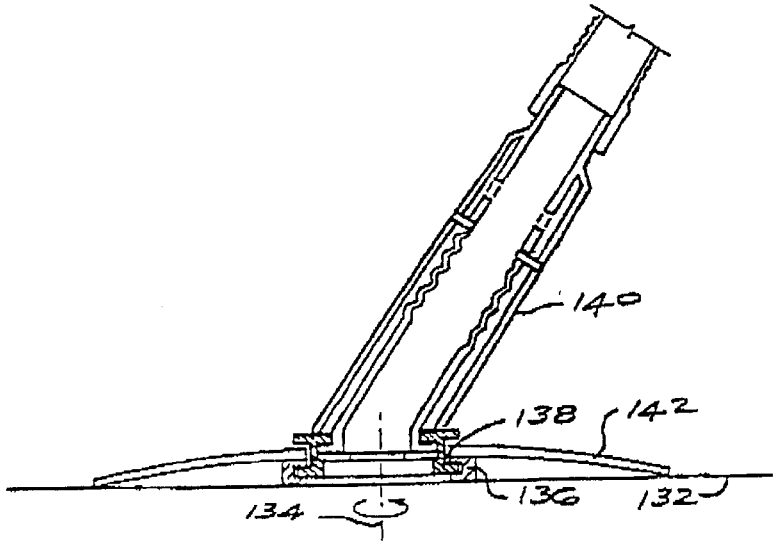
FIG 5

POOL CLEANER

BACKGROUND OF THE INVENTION

This invention relates to a pool cleaner and to a skirt for use with a pool cleaner.

SUMMARY OF INVENTION

The invention provides a pool cleaner which includes a body and at least one member which is secured to the body and which, in use, engages with a submerged surface which is to be cleaned, thereby preventing the body from directly contacting the submerged surface, at least part of the body and the member being rotatable relatively to each other.

Preferably the said relative rotation takes place about an axis which is substantially at right angles to the submerged surface with which the member engages.

In one form of the invention the body includes at least first and second parts which provide the said relative rotation, and the member is secured to the first part.

The first part may be formed with a suction inlet to the body and the member may surround the suction inlet. In a variation of the invention the member is one of a plurality of similar members located at spaced intervals around the suction inlet.

The pool cleaner may include a flexible skirt which is attached to the body and which is rotatable relatively to at least the second part, the skirt, in use, engaging with the said submerged surface.

According to a different embodiment of the invention the member includes a skirt which is rotatable relatively to the body and which, in use, engages with the said submerged surface.

The skirt and the body may include complementary flanges and groove formations which are inter-engageable to rotatable secure the skirt to the body.

The invention also extends to a skirt for use in a pool cleaner of the aforementioned kind which includes a central section and a flexible annular portion around the central section, the central section including a circular formation with at least one flange which extends radially, the central section being formed with an aperture which is within the confines of the circular formation.

At least the annular portion may include a plurality of non-radial formations.

The formations may take on any suitable shape and may for example extend generally from the central section across the flexible annular portion.

The formations, in one form of the invention, are generally in the shape of an elongate "S", or are elongate sinusoidal.

The periphery of the annular portion may be formed with a plurality of arcuate segments. The segments may, for example, be substantially convex and may be interspersed with concave segments. In a general sense the periphery may be formed with a sinusoidal formation.

The non-radial formations are preferably in the form of ribs which are raised and which extend from a generally planar surface of the annular portion.

Both sides of the annular portion may be substantially similarly formed or, in one embodiment, one side of the annular portion may include the aforementioned non-radial formations and the other side of the annular portion may be substantially smooth.

The central section may include a plurality of raised formations around the aperture. These formations may be in the nature of spaced wear resistant pads.

The invention also provides a skirt for a pool cleaner which includes a body which is made from flexible material and which, at least on one side, has a plurality of nonradial formations.

BRIEF DESCRIPTION OF THE DRAWINGS

The invention is further described by way of examples with reference to the accompanying drawings in which:

FIG. 3 is a cross-sectional side view of a pool cleaner and skirt combination according to a different arrangement of the invention, and FIG. 4 is an under plan view of a central area of the combination shown in FIG. 3, and FIG. 5 illustrates a variation of the invention.

DESCRIPTION OF PREFERRED EMBODIMENTS

Figure 1:
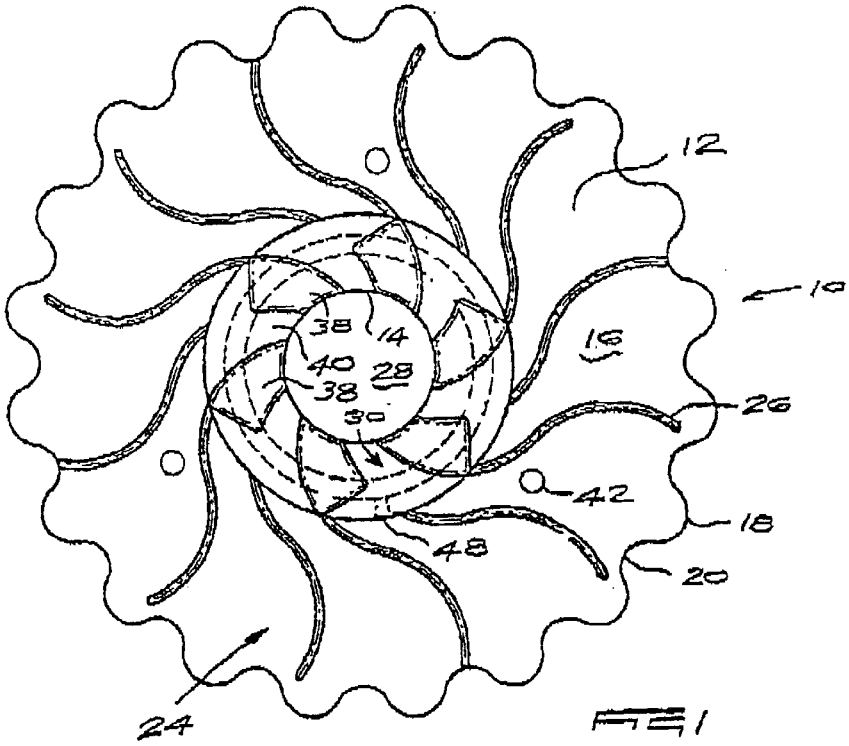
FIG. 1 is a plan view of an underside of a pool cleaner skirt according to one form of the invention.

FIG. 1 of the accompanying drawings illustrates a pool cleaner skirt 10 according to one form of the invention which is made from a suitable flexible abrasion and wear resistant material such as polyurethane:

The pool cleaner skirt has a generally circular sheetlike body 12 which has a central section 14, and a surrounding flexible annular portion 16 which, on its periphery, is formed with interspersed convex and concave formations 18 and 20 respectively which impart to the periphery a continuous substantially sinusoidal shape.

On what is referred to hereinafter as its upper surface 22 the body 12 is substantially smooth. On its lower side 24, which is the side shown in FIG. 1, the annular portion 16 has a plurality of non-radial formations 26, which are spaced from one another, and which extend generally from a central aperture 28 towards the periphery of the body. The formations 26 consist of ribs which are slightly raised from the lower side 24 and which are each in the form of an elongate S or a stretched sinusoidal wave shape.

The central aperture 28 is surrounded by a raised annular portion 30. The portion 30 is spaced from an adjacent opposing surface of a flange 32 of the body (see FIG. 2) in such a way that a circumferential recess or groove 34 is formed around the aperture 28. The recess is bounded on its opposed sides by the flange 32 and a flange 36, which extend radially inwardly.

A number of pads or raised formations 38 are formed at spaced intervals around the central aperture. In this example each pad 38 is positioned adjacent the aperture 28, and gaps 40,are formed between each pair of the pads.

A number of holes 42, spaced from the central aperture 28, are formed at regularly spaced intervals around the aperture.

Figure 2:
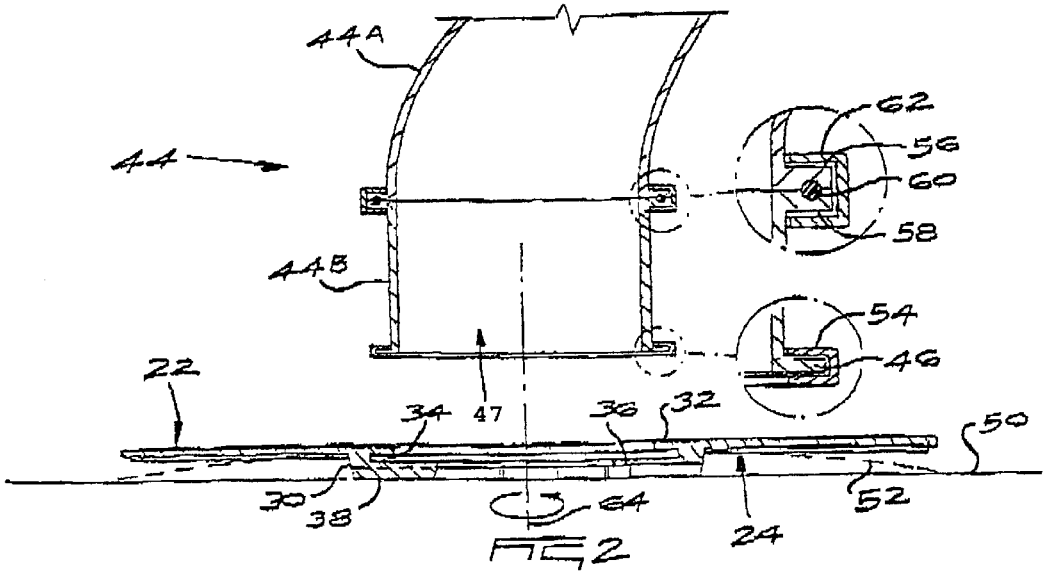
FIG. 2 is a cross-sectional side view of the skirt shown in FIG. 1 illustrating its engagement with a body of a pool cleaner, and possible variations of the invention.

The skirt 10 is intended for use with an automatic pool cleaner of the suction type. In FIG. 2 only a lower end 44 of a pool cleaner is illustrated. The lower end has an outwardly extending peripheral flange 46 which surrounds a suction inlet 47 of the pool cleaner. The skirt 10 is readily engaged with the flange 46 by deforming the flange 32 so that the flange 46 can be inserted into the recess 34. This type of maneuver is usually accomplished by virtue of the flexibility of the material from which the skirt is made.

Alternatively the flange 32 is formed with a small radial slit 48, shown in dotted outline in FIG. 1, and the flange 46 is engaged with the recess by threading the flange 46, with a rotary motion, through the slit and into engagement with the recess 34. This arrangement can be reversed and the flange 46 can be formed with a slit, not shown, through which the flange 32 is threaded, again with a twisting, rotary motion.

The lower side 24 of the skirt is the side which is brought into contact with a submerged surface 50 which is to be cleaned. The pads 38 raise the center of the skirt 10 and the periphery of the body then flexes slightly downwardly, towards the submerged surface as is indicated by dotted lines 52. The holes 42 can be varied according to requirement and control the degree of suction which is exerted by the pool cleaner. This in turn controls the strength of an adhering force which is created between the skirt and the submerged surface.

The gaps 40 permit water to flow between adjacent pads and, in this way, entrained dirt is carried into the suction inlet 47.

The function of a skirt on a suction type pool cleaner is known in the art and hence is not further described herein. The skirt of the invention does however hold certain advantages. Firstly is has been found that the non-radial formations 26, which are in contact with the submerged surface on which the skirt 10 rests, impart to the skirt a degree of rotational movement relatively to the pool cleaner. This assists in randomizing the movement of the pool cleaner as it moves across the submerged surface.

Secondly the central construction surrounding the aperture 28 is of an integral character compared to other constructions known to the applicant. Thus, in one case known to the applicant, formations which perform substantially the same function as the integral pads 38 are separately formed and hence are separately attachable to the body of the Pool cleaner. In another construction known to the applicant a wear resistant ring is engaged with the equivalent of the flange 46 of the pool cleaner and a separate skirt, which does not have the central construction described herein, is thereafter engaged with the pool cleaner at a position which is adjacent the location occupied by the wear resistant ring.

It has further been found that the peripheral generally sinusoidal formation which is evident in FIG. 1 assists in randomizing the movement of the pool cleaner and also assists in extricating the pool cleaner from locations in which the pool cleaner could otherwise be trapped.

Another benefit is that a skirt of the kind shown in the accompanying drawings can be manufactured using a mold of relatively simple, and hence inexpensive, construction.

A further significant benefit lies in the fact that the skirt is rotatable with comparative ease relatively to the pool cleaner. The skirt in effect prevents the pool cleaner body from directly contacting the submerged surface 50. It is to be born in mind that the skirt is caused to adhere to the submerged surface by the suction effect which is created through the suction inlet 47. The reduced pressure in the space between opposing surfaces of the skirt and the submerged surface causes the skirt to adhere to the surface. This adhering force does not however cause the pool cleaner to adhere directly to the surface 50 for, as noted, the skirt prevents the pool cleaner from directly contacting the surface. Thus the pool cleaner is able to rotate relatively to the skirt ever, though the skirt is adhering to the surface 50, with the rotation taking place as the flange 46 rotates in the recess or groove 34.

The aforementioned relative rotation which is possible means that the ability of the pool cleaner to prevent it from becoming jammed in an awkward or difficult location in the swimming pool is enhanced. Bearing in mind that the pool cleaner moves with a substantially random motion over the submerged surface situations do arise when due to a variety of factors which are related inter alia to the geometry of the pool cleaner and the geometry of the pool, the pool cleaner may become jammed in a particular position. If the skirt is not rotatable with comparative ease relatively to the pool cleaner then, when the skirt adheres to the submerged surface the pool cleaner is also, in effect, locked to the submerged surface and often cannot, on its own accord, release or extricate itself from the locked position.

A skirt of the type shown in FIGS. 1 and 2 allows the pool cleaner to rotate relatively to the skirt and this means that the direction in which the pool cleaner tends to move is altered. This freedom of movement is generally sufficient, in many pools, to enable the pool cleaner to extricate itself of its own accord from a position at which it may otherwise become jammed.

FIG. 2 illustrates an optional use of a hard plastic ring 54 which has a low friction coefficient relatively to the material from which the skirt is made. The ring is engaged with the flange 46 of the pool cleaner and is inserted together with the flange into the recess or groove 34 to provide a low friction interface between the skirt and the flange 46.

FIG. 2 illustrates a further modification which may be effected in that the lower end 44 of the pool cleaner may be formed with an upper part 44A and a lower part 44B which are rotable relatively to each other. The two parts include mating flanges 56 and 58 respectively, which optionally have an O-Ring seal 60 between opposing surfaces, and which are held to one another in a loose, freely-rotatable manner by means of an external collar or clamp 62. This arrangement further enhances the ability of the pool cleaner to rotate relatively to the skirt and this increases the maneuverability of the pool cleaner and its ability to extricate itself from difficult positions in a swimming pool.

Although the pool cleaner may rotate relatively to the skirt around any suitable axis it is preferred, as is shown in FIG. 2, for such relative rotation to take place about an axis 64 which is substantially at right angles to the submerged surface 50 with which the pool cleaner is engaged. The right angled relative rotation means that no direction of movement of the pool cleaner is favored over another direction and the construction details required for effecting relative rotation are Simplified.

FIGS. 3 and 4 illustrate another embodiment of the invention.

FIG. 3 illustrates a lower end of a pool cleaner 102, in cross-section and from the side. The pool cleaner has a body 104 which includes at least a first pan 106 and a second part 108.

As is the case with the variation of the invention which has been described in connection with FIG. 2, the first and second parts include mating flanges 110 and 112 respectively with an optional O-ring seal 114 between them. The flanges are held together in a manner which enables the first part to rotate freely relatively to the second part by means of a low friction clamp 116.

Wear resistant pads 118 are fixed to a lower flange 120 of the part 106, at spaced intervals around a suction passage 122 which extends through the part 106, see FIG. 4.

An annular skirt 124 of a suitable flexible wear resistant material such as polyurethane is engaged with the part 106 with its inner periphery situated between opposing surfaces of the flange 120 and the flange 110. The skirt is preferably rotatable relatively to the part 106 although this is not essential.

An actuating mechanism 126 of a kind which is known in the art and which is not further described herein is positioned inside the second part. The mechanism 126 is kept in position by means of a disk 128 which has a central aperture 130. When water flow is induced by suction force through the body of the pool cleaner the mechanism 126 affects the water flow in a manner which causes random movement of the pool cleaner over a submerged surface 132.

When suction is applied to the pool cleaner the skirt 124 is caused to adhere to the surface 132 due to the resulting decrease in pressure which prevails between the skirt and the submerged surface and within the passage 122, Thus the lower part 106 of the pool cleaner is caused to adhere to the submerged surface. The upper part 108, as has been noted, is freely rotatable relatively to the lower part and, in a manner which is similar to what has been described in connection with the arrangement shown in FIGS. 1 and 2, the relative rotational movement, which takes place about an axis 134 which is more or less perpendicular to the submerged surface 132 with which the pool cleaner is engaged, enhances the random movement of the pool cleaner and assists the pool cleaner in extricating itself from positions at which it could otherwise become jammed.

Note that in the FIG. 3 embodiment although the part 106 of the body of the pool cleaner is caused to adhere to the submerged surface the remainder of the body of the pool cleaner, which is substantially larger than the body part 106, can rotate relatively freely with respect to the lower part. Thus the part 106, together with the wear resistant pads 118 and the skirt 124, which normally has a relatively simple construction but which could readily incorporate one or more features of the skirt shown in FIG. 1, combine to act in the same way as the arrangement shown in FIG. 2 where the entire body of the pool cleaner rotates relatively to the skirt.

FIG. 5 illustrates a variation of the FIG. 3 embodiment wherein a wear resistant disk 136 is engaged with a flange 138 of cleaner 140 which is similar in many respects to the cleaner 102 of FIG. 3.

The disk 136 can rotate freely on the flange 138.

An annular skirt 142 is engaged with the cleaner. The skirt is formed separately from the disk and is also rotatable relatively to the cleaner.

The arrangement shown in FIG. 5 also possesses the advantages which have been described hereinbefore with respect to the skirt arrangement shown in FIGS. 1 and 2.

What is claimed is:

1. A pool cleaner comprising:

a body through which, in use, water flows;

a member which, in use, engages with a submerged surface which is to be cleaned and prevents the body from contacting the submerged surface; and further a connecting element which joints the body to the member, the connecting element being rotatable relative to the member, wherein the body is rotatable relative to the connecting element.

2. The pool cleaner according to claim 1 wherein the connecting element is mounted within an interior opening of the member and is rotatable within the interior opening of the member.

3. The pool cleaner according to claim 1 wherein the relative rotation takes place about an axis which is substantially at a right angle to the submerged surface with which the member engages.

4. The pool cleaner according to claim 3 wherein the member comprises a skirt which is rotatable relative to the body and which, in use, engages with the submerged surface.

5. The pool cleaner according to claim 3, wherein the connecting element is formed with a suction inlet to the body and the member surrounds the suction inlet.

6. The pool cleaner according to claim 3, further comprising a flexible skirt which is attached to the body and which is rotatable relative to the body, the skirt, in use, engaging with the submerged surface.

7. The pool cleaner according to claim 1 wherein the connecting element is formed with a suction inlet to the body and the member surrounds the suction inlet.

8. The pool cleaner according to claim 7 further comprising a flexible skirt which is attached to the body and which is rotatable relative to the body, the skirt, in use, engaging with the submerged surface.

9. The pool cleaner according to claim 1 further comprising a flexible skirt which is attached to the body and which is rotatable relative to the body, the skirt, in use, engaging with the submerged surface.

10. The pool cleaner according to claim 1 wherein the member comprises a skirt which is rotatable relative to the body and which, in use, engages with the submerged surface.

11. The pool cleaner according to claim 10 wherein the skirt and the body comprise complementary flange and groove formations which are interengageable to rotatably secure the skirt to the body.

12. The pool cleaner according to claim 10 wherein the skirt comprises a central section and a flexible annular portion around the central section, the central section comprising a circular formation with at least one flange which extends radially, the central section being formed with an aperture which is within the confines of the circular formation.

13. The pool cleaner according to claim 12 wherein at least the annular portion comprises a plurality of non-radial formations.

14. The pool cleaner according to claim 12 wherein the central section comprises a plurality of raised formations around the aperture.

15. The pool cleaner according to claim 1 wherein the body comprises a suction inlet which, in use, opposes the submerged surface, and wherein the member comprises a skirt which is engaged with the body and which is rotatable relative to the body around the suction inlet, the skirt, in use, spacing the body from the submerged surface.

16. A skirt for use in a pool cleaner which includes a body which is made from flexible material, the body including a formation for engaging with the pool cleaner and, at least on one side of the body, a plurality of non-radial raised rib formations, wherein each of the rib formations is in the form of an elongate S.

17. A pool cleaner comprising:

a body through which, in use, water flows;

a member which, in use, engages with a submerged surface which is to be cleaned and prevents the body from contacting the submerged surface; and a connecting element which joints the body to the member, the connecting element being rotatable relative to the member, wherein the member comprises a skirt which is rotatable relative to the body and which, in use, engages with the submerged surface, and wherein the skirt and the body comprise complementary flange and groove formations which are interengageable to rotatably secure the skirt to the body.

18. A pool cleaner comprising:

a body through which, in use, water flows;

a member which, in use, engages with a submerged surface which is to be cleaned and prevents the body from contacting the submerged surface; and a connecting element which joints the body to the member, the connecting element being rotatable relative to the member, wherein the member comprises a skirt which is rotatable relative to the body and which, in use, engages with the submerged surface, wherein the skirt comprises a central section and a flexible annular portion around the central section, the central section comprising a circular formation with at least one flange which extends radially, the central section being formed with an aperture which is within the confines of the circular formation, and wherein at least the annular portion comprises a plurality of non-radial formations.

* * * * *